United States Patent [19]

Schützer

[11] 4,340,214

[45] Jul. 20, 1982

[54] TRAINING APPARATUS FOR SKATERS

[76] Inventor: Björn E. Schützer, Morkullegatan 1, Askersund, Sweden, 696 00

[21] Appl. No.: 159,201

[22] Filed: Jun. 13, 1980

[30] Foreign Application Priority Data

Jun. 18, 1979 [SE] Sweden ..... 7905337

[51] Int. Cl.[3] ..... A63B 23/04; A63B 69/18

[52] U.S. Cl. ..... 272/70; 272/97; 272/130; 272/138; 272/DIG. 4

[58] Field of Search ..... 272/70, 97, 134, 135, 272/136, 137, 138, 139, 140, 141, 142, 146, 130; 434/247, 253, 255

[56] References Cited

U.S. PATENT DOCUMENTS

| | | | |
|---|---|---|---|
| 2,455,274 | 11/1948 | Scriver | 272/97 |
| 3,531,110 | 9/1970 | Marchu | 272/97 |
| 3,702,188 | 11/1972 | Phillips et al. | 272/130 |
| 3,834,693 | 9/1974 | Poppenberger | 272/97 |
| 3,912,260 | 10/1975 | Rice | 272/97 |

FOREIGN PATENT DOCUMENTS

| | | | |
|---|---|---|---|
| 2262362 | 9/1975 | France | 272/97 |
| 385085 | 5/1965 | Switzerland | 272/97 |

*Primary Examiner*—Richard J. Apley
*Assistant Examiner*—Arnold W. Kramer
*Attorney, Agent, or Firm*—Dennison, Meserole, Pollack & Scheiner

[57] ABSTRACT

Training apparatus (1) for skaters consisting of a fixed training stand with two carriages transversely displaceable in opposite directions, the displacement of which is controlled. Each carriage has a platform for the attachment of one of the skater's feet, said platform altering its angle of inclination upon displacement of the associated carriage from the initial position in the same way as a skate when cutting the ice. The lateral displacement of each carriage occurs against the action of a force which is adjustable.

9 Claims, 7 Drawing Figures

TRAINING APPARATUS FOR SKATERS

Figure 1:
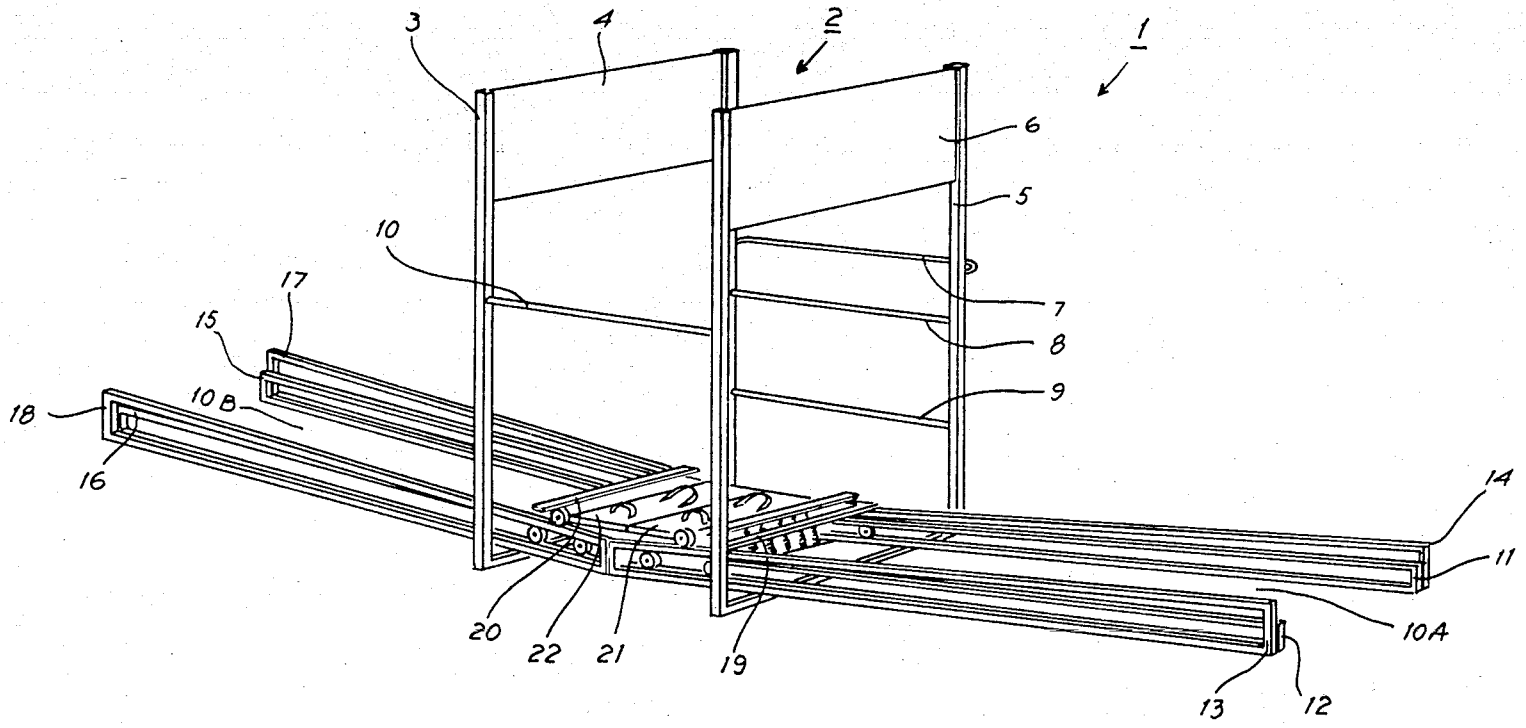

The present invention relates to a training apparatus for skaters. Hitherto it has only been possible for skaters to train when ice is available, for instance on frozen lakes or skating rinks. However, the training time in both ice rinks and on frozen lakes is rather limited and in order to reach top form a skater must be able to train substantially all the year round. There has hitherto been no chance of such training. However, it has been possible for skiers to train all the year round since skis have been developed with wheels to enable the skier to use ordinary roads in order to properly train the muscles used in skiing.

The present invention aims at remedying the situation for skaters so that they also have the chance of training all year to be in top form when the skating season starts. The deficiency is remedied by the development of an apparatus which has two units which are movable in opposite transverse directions. Each unit includes a part to which one of the skater's feet is secured in such a way that the direction of the foot blade is perpendicular to the movement of the units.

The two units have a common starting position and can be moved to and from this starting position. A support means is arranged at this starting position so that the skater always has a fixed position in relation to the apparatus according to the present invention.

The skater's feet are directly or indirectly secured to said units and he can therefore displace the units from starting position from his support. When displacing said units the skater trains his muscles in the same way as when he makes a conventional cut in ice.

Each unit is arranged so that, upon displacement, it follows a specific path, this being achieved by guide means of known type.

The part to which the skater's foot blade is secured assumes an angle during displacement of the unit, which substantially corresponds to the angle obtained when the blade of a skate cuts the ice. The pivoting of the part can be achieved either by means of relative movement in relation to the part or the unit as such can be arranged to assume such an angle upon displacement that a relative movement between the part to which the foot blade is secured and the unit is superfluous.

Each unit is designed so that when displacing the unit the skater must overcome a predetermined force. This force may be exerted by springs, hydraulically or in some other way. The force to be overcome can be preset and it may also be arranged so that when the unit is displaced the force gradually increases.

According to one embodiment of the invention said pre-stressed force can be achieved by means of springs. A large number of springs may thus be arranged which gradually come into use in order to increase the training strength of the skater's muscles.

Furthermore, each unit may be designed so that when it is not subjected to displacement by the skater's foot, it automatically returns to its initial position.

According to a special embodiment of the present invention, each unit may move in a horizontal plane so that the part to which the skater's foot is attached must perform a relative movement to the displaced unit. This can be achieved by allowing the part to which the skater's foot is attached to follow a path which is inclined in relation to the path followed by the unit. In such a construction one or more springs may be arranged between the unit and associated part so that when the unit is moved the associated part acquires a relative movement to the unit while one or more springs are simultaneously tensioned which cooperate between the associated part and the unit.

Further features characterising the invention are revealed in the following claims.

Figure 2:
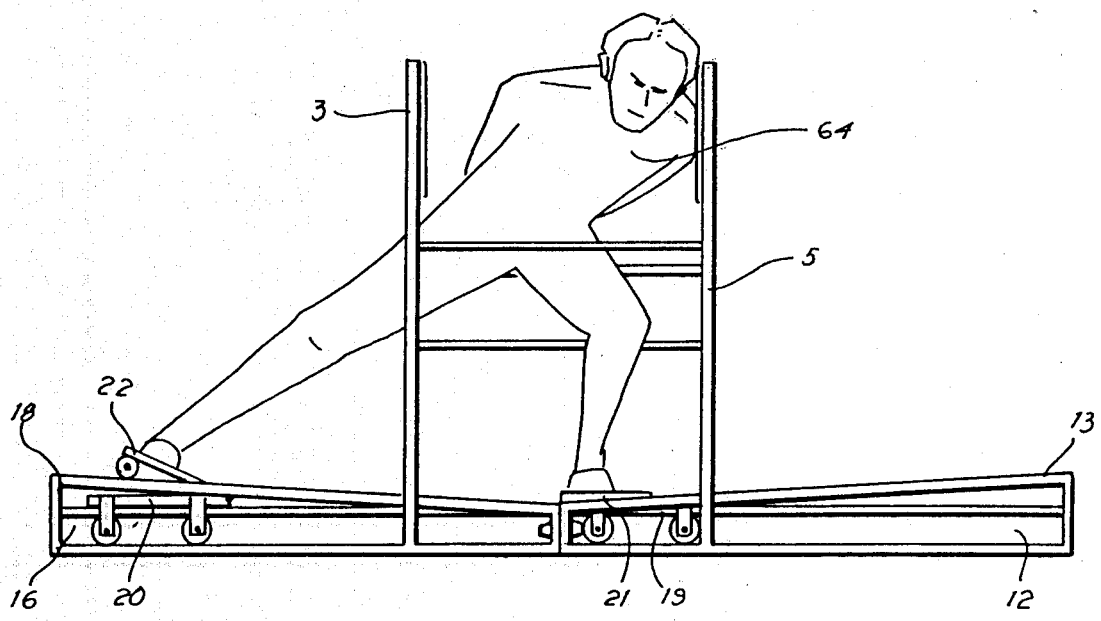
Figure 3:
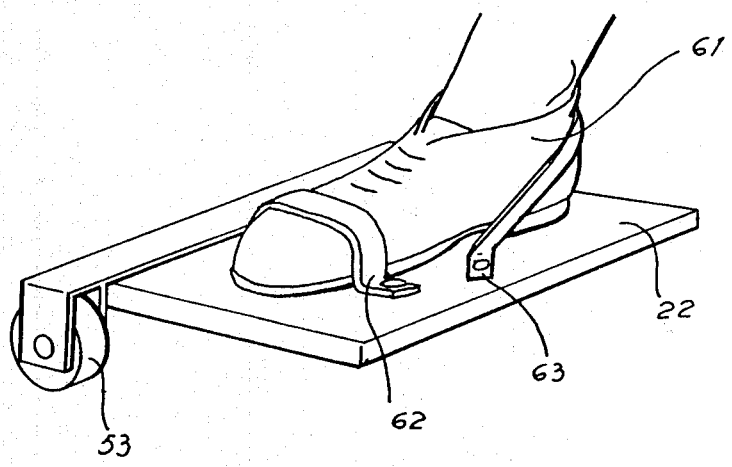
Figure 4:
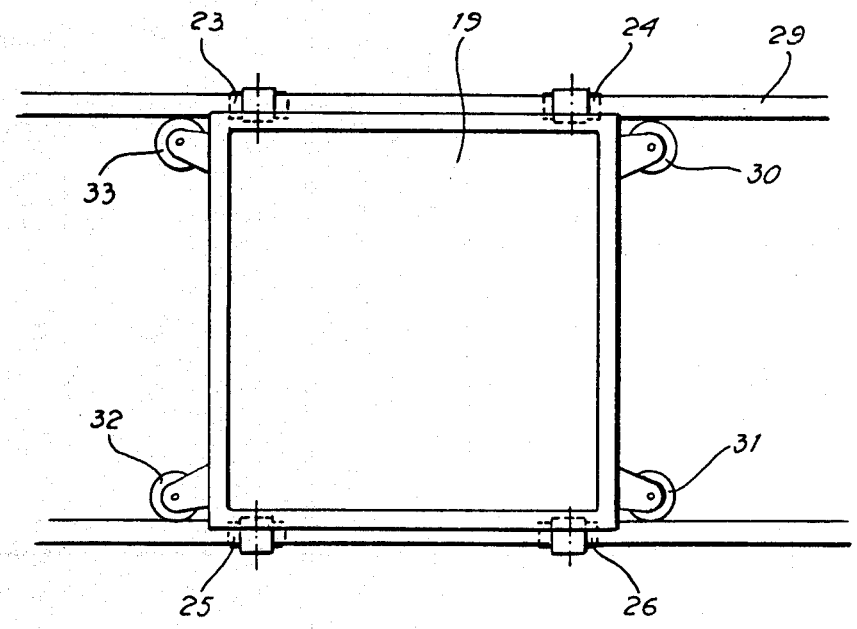
Figure 5:
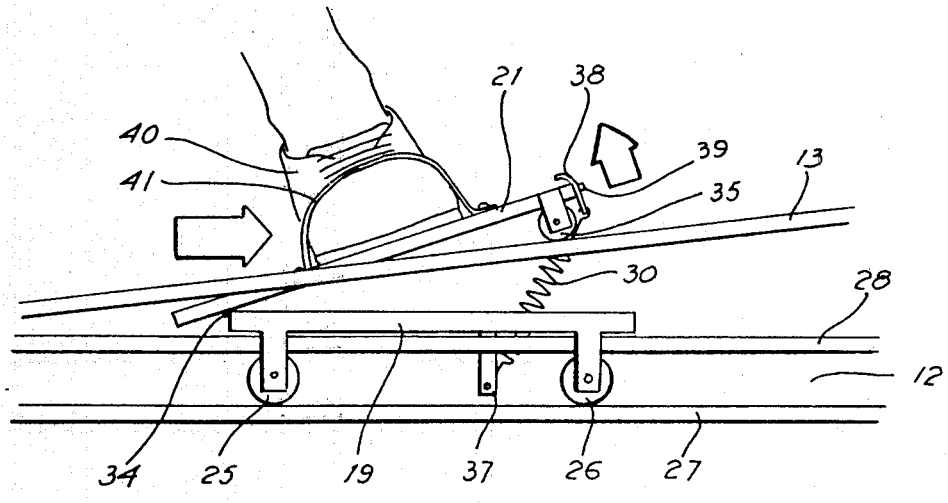
Figure 6:
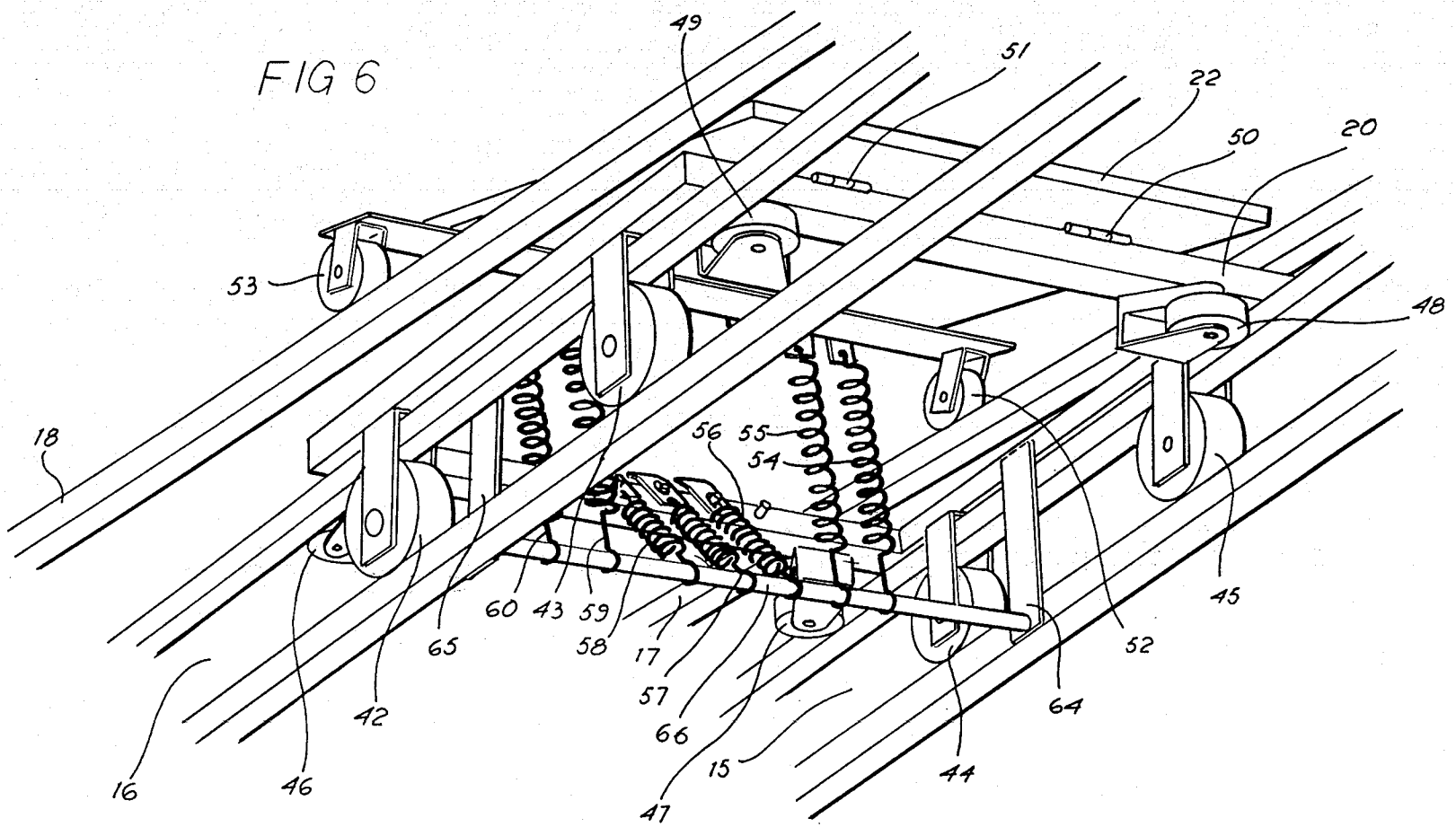
Figure 7:
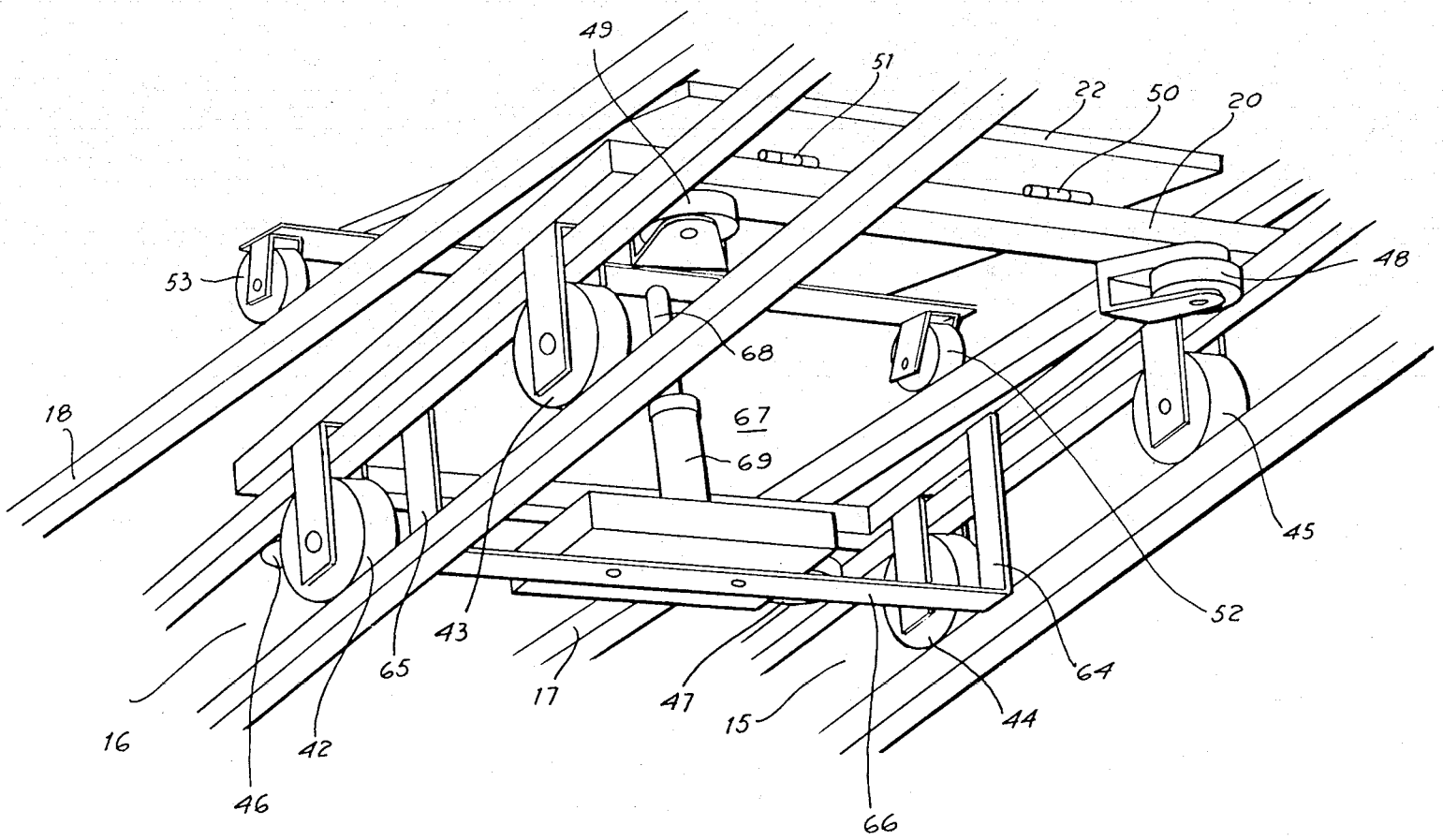

One embodiment of the present invention will be described more fully by way of example with reference to the accompanying five sheets of drawings in which FIG. 1 shows in perspective a training apparatus according to the present invention, FIG. 2 shows in front elevation the training apparatus according to FIG. 1 with a skater in training, FIG. 3 is a perspective showing a part for securing the right foot of a skater, FIG. 4 is a plan view of a unit seen from above, FIG. 5 shows a unit for the left foot provided with a part to secure the foot of a skater, FIG. 6 shows the left side of the training apparatus according to FIG. 1 in more detail so that both displaceable unit and part movable in relation to the displaceable unit can be seen quite clearly, and FIG. 7 shows the same unit as FIG. 6 except that the force to be overcome by the right leg of the skater is produced hydraulically.

The drawings show a training apparatus 1 provided with a stand 2 at its centre, formed by two U-shaped frames 3 and 5 located parallel to each other, the legs pointing straight up. The free ends of the legs are joined at the top by partitions 4 and 6. The two frames, spaced from each other, are held together by cross-stays 7, 8, 9 and 10. The stand is of suitable width for a skater and at the bottom of the stand are two units or carriages 19 and 20. Each carriage is provided with a foot plate 21 and 22, respectively. The carriage 19 with foot plate 21 is movable to the right along a guide system 10A and the carriage 20 with foot plate 22 is movable to the left with the help of a guide system 10B arranged on the left side. Both guide systems 10A and 10B are arranged transversely in relation to the foot plates 21 and 22. The right system 10A consists of two rectangular frames 11 and 12 located horizontally. The vertical parts of the frame on the left terminate at the centre of the stand. The inner sides of the frames 11 and 12 are designed for abutment with wheels pertaining to the carriage 19. FIG. 4 shows clearly that the carriage 19 is provided with four wheels 23, 24, 25 and 26 which are in abutment with the longitudinal parts of the frames 11 and 12. To prevent the carriage 19 from being displaced laterally, the carriage is provided with four wheels 30, 31, 32 and 33 which are in contact with the inner sides of the frames, in this case with the upper part of the longitudinal frame parts. The two frames 11 and 12 are horizontal so that the carriage 19 is displaced solely in horizontal direction. Two frames 13 and 14 are arranged beside the frames 11 and 12. These frames differ from the frames 11 and 12 in that the upper frame part of each slopes inwardly. The upper side of each upper frame constitutes a contact surface for two wheels, one of which is visible in FIG. 5 and is designated 35. The wheel is attached to the foot plate 21 which is journalled by means of a hinge 34 to the carriage 19. This means that when the carriage 19 is displaced to the right, the foot plate 21 will move in relation to the carriage 19 and during this movement the foot plate will acquire an angle corresponding to the angle of the foot when skating.

The guide system 10B on the left side is constructed in exactly the same manner as the guide system 10A on the right and the carriage 20 with foot plate 22 is displaced in exactly the same manner as the carriage 19 with foot plate 21. The left guide system consists of two guide frames 15 and 16 for the carriage 20 and two guide frames 17 and 18 for the foot plate 22.

FIG. 3 shows how the right foot of a skater 64 is secured to the foot plate 22 by means of two fixtures 62 and 63 which retain the foot 61 of the skater 64. FIG. 5 also shows the left shoe 40 of the skater 64, which is secured by a fixture 41 to the foot plate 21. The wheels 25 and 26 of the carriage 19 run between the upper and lower parts of the longitudinal frame 12, these parts being designated 27 and 28. The carriage 19 is also provided with a stay 37 to which one end of a spring is secured. The other end of the spring is provided with a special attachment eye which can be secured to the right part of the foot plate on a pin 39. The foot plate 21 is also provided with a wheel 35 which runs on the upper side of the frame 13 and is provided with a hinge at its left side. From this it can be seen that when the carriage 19 is displaced to the right the angle of inclination between the foot plate 21 and the carriage 19 will be altered and the spring 30 simultaneously stretched.

FIG. 6 shows in more detail how a carriage with associated foot plate is constructed. The carriage is identical to that shown in FIG. 5 but in FIG. 6 the carriage shown is the left carriage in the training apparatus according to FIG. 1.

FIG. 6 shows the two frames 15 and 16 and the upper part of the frames 17 and 18. Wheels 42, 43, 44 and 45 run in the frames 16 and 15 of the carriage 20. Support wheels 46, 47, 48 and 49 abut against the inner, upper edge surfaces of the guide frames 16 and 15 to prevent the carriage from being subjected to lateral movement. The foot plate is pivotable in relation to the carriage 20 by means of hinges 50 and 51. At the end opposite to that in which the hinges 50 and 51 are secured, the foot plate is provided with two wheels 52 and 53 which are in contact with the upper side of the guide frame 17, 18. The carriage 20 has two braces 64 and 65 and between these is a shaft 66. The ends of the springs 54, 55, 56, 57, 58, 59 and 60 are attached to this shaft. The other ends of the springs can be secured one by one as desired to the left side of the foot plate 22, thus increasing the spring load from one up to seven springs. As can be seen clearly in FIG. 6, when the carriage 20 is displaced to the left the spring which is hooked on will be gradually placed under tension, thus producing the desired resistance for displacement of the carriage to the left.

FIG. 7 shows exactly the same carriage with foot plate as in FIG. 6. The springs have been replaced here by a hydraulic means 67 with a piston rod 68 and cylinder 69. The piston and cylinder may be actuated by any suitable means from liquid to gas.

As is clear from FIG. 6, it should be obvious that the carriage 20 when not subjected to displacement to the left will, due to the tendency of the springs to pull together, will move to the central position shown in FIG. 1. It should also be obvious that springs can also be arranged with one end at the centre of the stand and the other end at each carriage. Each carriage will thus also be returned to its rest position as shown in FIG. 1.

The training apparatus described above functions as follows: A skater 64 positions himself in the stand 2 as shown in FIG. 2. He attaches his shoes to the foot plates 21 and 22 as shown in FIGS. 3 and 5. The skater then performs the leg movements normal to him when he is skating. Due to the frames 13, 14 and 17, 18, the foot plates 21 and 22 will, upon movement of the carriages 20 and 21 to left and right, perform displacement and turning movements corresponding exactly to the turning and displacement movement occurring when skating normally. In view of the existance of the springs between a foot plate and its carriage, a displacement of the carriage must occur against the action of a certain force and this force can be regulated by hooking on the desired number of springs. A skater can thus gradually train his leg muscles to peak form for a winter season. Due to the arrangement shown in FIG. 6, each carriage will automatically return to the rest or original position shown in FIG. 1 as soon as the skater withdraws his leg.

An example has been shown above of how the musculature of a skater can be trained by displacing carriages in transverse direction in relation to his body, these carriages describing a movement which substantially corresponds to the movement of a skate. The carriages should also enable the foot blade of the skater to assume the same angle as that obtained during normal skating. Furthermore, the carriages should offer a certain mechanical resistance to the movement of the skater. This means that, without being circumvented, the invention may consist of carriages or the like with forced transverse movement which directly or indirectly effect pivoting of the foot to agree with the pivoting obtained during normal skating on ice. furthermore, the resistance of each carriage to transverse displacement can be effected in a plurality of ways within the scope of the invention. Under certain circumstances it may even be advisable to allow the foot to be subjected to pivoting movements other than those normal in skating. This is in order to train the foot musculature more efficiently.

I claim:

1. A training apparatus for skaters comprising stationary horizontal rail means extending laterally from each other and normal to the skating direction, separate carriage means displaceable along each of said rail means in opposite directions, a pair of foot plate means for receiving the skater's feet, each foot plate means having an inboard and outboard end and being hingedly mounted on one of said carriage means and movable therewith, and ramp means cooperating with said foot plate means for continually increasing the angle of inclination of the entire foot plate means with respect to the rail means upon displacement of the carriage means outwardly of its respective rail means, wherein the outboard end of the foot plate means moves upwardly with respect to the inboard end during said carriage displacement.

2. A training apparatus as defined in claim 1 and further including pre-stress means for each of said carriage means which must be overcome upon displacement.

3. Training apparatus according to claim 2, wherein the pre-stress means consists of one or more springs which can be brought into and out of function.

4. Training apparatus according to claim 2 wherein the pre-stress means is of pneumatic or hydraulic type.

5. A training apparatus as defined in claim 2 wherein the pre-stress means also serves to return the carriage means to an initial starting position.

6. A training apparatus as defined in claim 2 wherein the pre-stress means provides increasing resistance as the carriage means is displaced from its initial position.

7. A training apparatus as defined in claim 1 wherein said foot plate means is pivoted to said carriage means on its inner end.

8. A training apparatus as defined in claim 1 and further including a plurality of wheels on each carriage means, said wheels running on said rail means.

9. A training apparatus as defined in claim 8 and including additional wheel means journalled at substantially right angles to said first mentioned wheels for preventing forward or backward movement of said carriage means.

* * * * *